United States Patent [19]

Nolan

[11] Patent Number: 4,699,286

[45] Date of Patent: Oct. 13, 1987

[54] PLASTIC BOTTLE CAPS

[75] Inventor: Robert L. Nolan, New York, N.Y.

[73] Assignee: Bankers Trust Co., New York, N.Y.

[21] Appl. No.: 869,371

[22] Filed: Aug. 7, 1986

Related U.S. Application Data

[63] Continuation of Ser. No. 765,186, Aug. 13, 1985, abandoned; which is a continuation of Ser. No. 597,190, Apr. 5, 1984, abandoned.

[51] Int. Cl.[4] ..... B65D 41/48

[52] U.S. Cl. ..... 215/256; 215/305; 215/321

[58] Field of Search ..... 215/256, 305, 321

[56] References Cited

U.S. PATENT DOCUMENTS 3,142,403 7/1964 Fox ..... 215/256

4,166,552 9/1979 Faulstich ..... 215/256

4,438,857 3/1984 Bullock ..... 215/256

*Primary Examiner*—Donald F. Norton

[57] ABSTRACT

Plastic bottle caps of the snap-on type having tamper indicating means such as a tear band. The top wall of the tap overhangs its side wall and the overhanging lip is filleted at an angle of about 30° to increase the difficulty of removing the cap by hand without visibly affecting the tamper indicating means. Also, the cap has interior interrupted beads for snapping over a shoulder of the bottle neck and has ribs in the interruptions for adjusting the magnitude of the snap-on and snap-off forces. The cap is molded on a core having grooves for forming the beads and ribs. The cap may have a non-resilient gasket and a dished top so that it can exert pressure on the gasket.

12 Claims, 9 Drawing Figures

PLASTIC BOTTLE CAPS

This is a continuation of abandoned application Ser. No. 765,186. filed Aug. 13, 1985 which was a continuation of abandoned application Ser. No. 597,190, filed Apr. 5, 1984.

This invention relates to plastic bottle caps of the snap-on type having tamper indicating means (e.g., a tear band), particularly for light weight plastic milk bottles. Caps fo this type are well known in the art. They have circular top walls and generally cylindrical side walls. See for instance U.S. Pat. No. 3,338,446.

The invention is described below by reference to the drawings, in which

Figure 3:
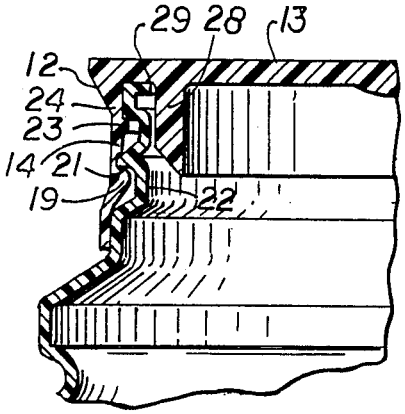
Figure 4:
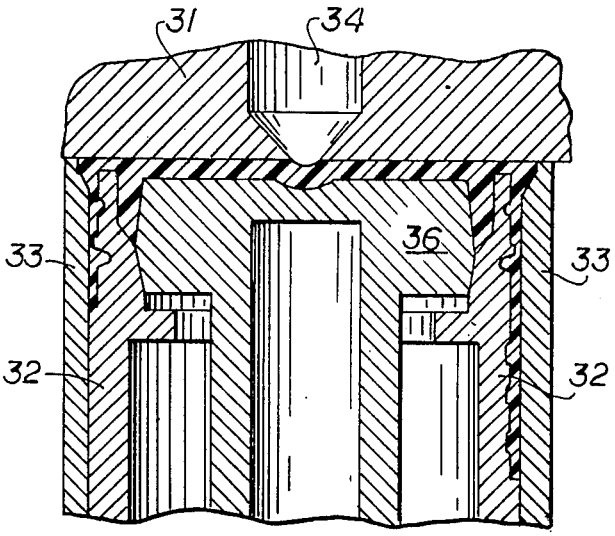
Figure 5:
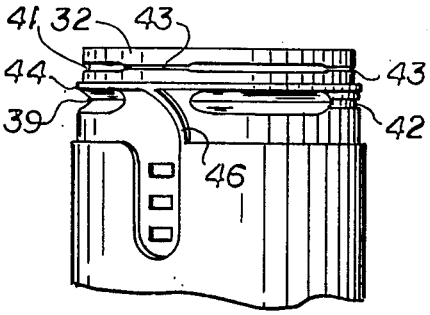
Figure 6:
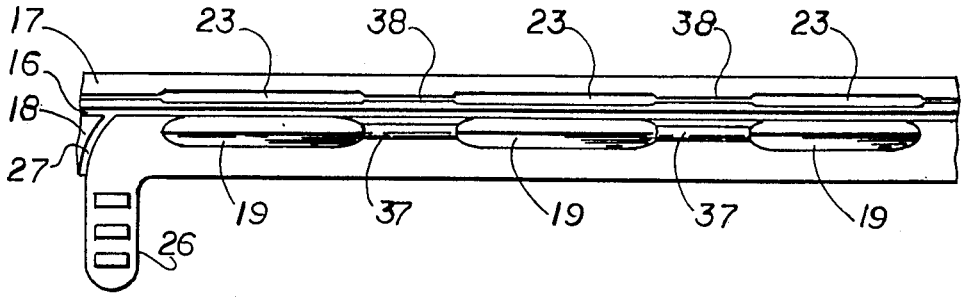
Figure 7:
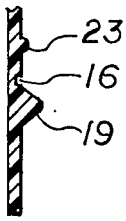
Figure 8:
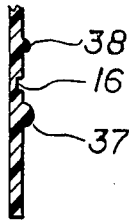

FIG. 3 is a cross-sectional side view of a cap of the invention in place on the neck of a bottle (with about half of the cap and the bottle neck broken away), FIG. 4 is a cross-sectional side view of the cap being molded in a mold having a core, FIG. 5 is a side view of a mold core, FIG. 6 is a view of the interior of the side wall of the cap developed in a plane to show its beads, ribs and lines of weakness, FIG. 7 is a cross sectional view of the side wall of the cap, taken along a vertical plane passing through its beads, FIG. 8 is a view like FIG. 7 but taken along a vertical plane passing through its ribs.

Figure 9:
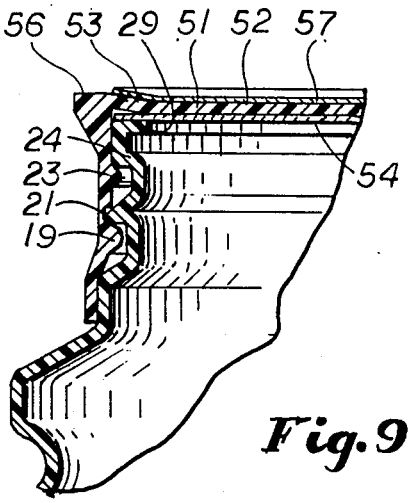

FIG. 9 is a cross-sectional side view of a cap having a gasket.

The standard plastic milk bottle necks for use with snap caps have outer diameters of about 1.38 inch at the widest, and the outer diameters of the cylindrical side walls of the caps are correspondingly about 1.39 inch. The nutritional etc. information required for milk bottles is usually set forth in a label (e.g. of paper) secured to the circular top wall of the cap. To accommodate this information in readable form the industry usually employs circular labels having diameters of 1⅜ inch. The operation of securing the labels to the top walls of the caps is not done with great precision and it is therefore desirable that the top wall have a diameter of at least about 1.5 inch in order to insure that the entire label will fit on said top wall. Accordingly, the top wall has been extended so that there is an overhanging lip or flange, as shown for instance in U.S. Pat. Nos. 3,927,784 and 4,166,552. This lip or flange aids in prying the cap off the bottle after the tamper-indicating means of the cap has been inactivated (e.g. after its tear band has been removed). The plastic material of the cap is flexible and the lip accordingly yields somewhat under the pressure of the fingers so that the amount of force that can be applied to the cap is limited and the cap cannot generally be removed by hand before the inactivation of the tamper indicating means.

Figure 1:
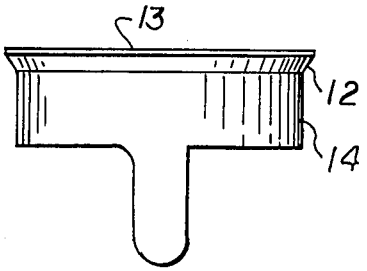
FIG. 1 is a side view of a cap of the invention.
Figure 2:
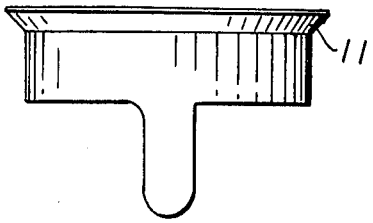
FIG. 2 is a similar side view of another cap.

Making the lip rigid, as by filleting it at a 45° angle (see 11 at FIG. 2), allows the hand to exert a larger prying force and increases the possibility of cap removal by hand even when the tamper indicating means has not been deactivated. I have found, however, that when the lip is made still more rigid by filleting it at an angle of about 30° (see 12 at FIG. 1), the opposite effect is obtained. That is, I have found that with the latter construction it instead becomes much more difficult to remove the cap by hand without visibly affecting the tamper indicating means (although it is readily removable by hand after the tear band has been torn away).

The cap shown in FIGS. 1 and 3–8 comprises a top wall 13 and a side wall 14. A circumferential line of weakness 16 (See FIG. 6) divides the side wall into an upper portion 17 and a removable lower portion 18. The lower side wall portion has an inwardly projecting interrupted bead 19 for engaging under a shoulder 21 of the bottle neck 22 (see FIG. 3). The upper side wall portion also has an inwardly projecting interrupted bead 23 for engaging under an upper shoulder 24 of the bottle neck. For removal of the lower portion the latter has a tab 26 adjacent to which there is a line of weakness 27 which extends upward to the circumferential line of weakness 16, so that when the tab is pulled appropriately the plastic of the cap tears first along the line 27 and then along the line 16.

The top wall 13 overhangs the side wall 17. Its outer diameter is about 1½ inches, while the outer diameter of the side wall is typically about 1.39 inches. The overhang is filleted (at 12) at an angle of about 30°.

In one preferred form, the top wall has an annular plug portion 28 depending therefrom. This plug fits into the mouth of the bottle to form a seal with the inwardly extending upper lip 29 of the bottle neck.

The caps may be produced by injection molding in molds of generally conventional type (see FIG. 4) in which the mold cavity is defined by an end member or plate 31, a core 32 and a sleeve 33. The hot molten plastic is injected, typically, through a gate 34 leading through the end member 31; it cools quickly to a solid self-supporting state in contact with the cooler mold elements. Then the mold is opened, i.e., the core and sleeve are moved relatively away from the end member and the formed solid cap is pushed off the core by an ejector pin 36 carried in the core. Since there are undercuts, etc. in the core the cap must expand somewhat when it is being stripped from the core. Such expansion is permitted because the core then moves, relatively, with respect to the sleeve (whose movement is suitably restrained as by springs, not shown), e.g., the core slides within the sleeve so as to bring the molded cap away from the sleeve.

As shown in FIG. 6 the inwardly facing beads 19, 23 of the cap may be interrupted. One aspect of this invention relates to the use of ribs 37, 38 in the interruptions. The mold core 32 (FIG. 5) has spaced relatively deep grooves 39, 41 (e.g. about 0.035 and 0.007 inch deep, respectively) to form the beads which engage the shoulders 21,24 of the bottle neck and relatively shallow grooves 42, 43 (e.g. 0.01 and 0.003 inch deep respectively)to form the ribs 37, 38 whose purpose is explained below. It will be understood that the heights of the beads and ribs of the cap correspond (approximately since there is some shrinkage of the plastic) to the depths of the grooves in which they are formed. Preferably the ribs are of smaller cross sectional area than the beads.

When the cap is snapped on to the bottle neck it tends to expand circumferentially, when a bead slides into a shoulder of the bottle neck, and then contract when that bead snaps over that shoulder. The downward force needed to snap the cap onto the bottle depends, at least in part, on the resistance of the plastic material of the cap to such expansion. The needed downward force should not be so great as to damage the light-weight plastic milkfilled bottle on which the cap is being placed. It is desirable, however, that the upward force needed to unsnap the cap from the bottle be so great that it is practically impossible to do so by hand without damaging the tamper indicating means. I have found that I can adjust the magnitude of these forces by adjusting the heights (and widths) of the ribs between bead portions. The greater the cross sections of the ribs, the greater are the forces required to stretch the ribs during the snap-on and attempted snapoff operations. The adjustment can be made, for instance, by starting with a core having no rib-forming grooves and which will yield a cap for which the snap-off force is too low and then machining the rib-forming grooves progressively deeper and deeper until the resulting mold produces a cap which has the required characteristics.

In the absence of the ribs the side wall thickness between bead sections is generally substantially the same as the general thickness of the side walls (usually about 1/40 inch). The ribs of course effectively thicken the side walls locally. In one preferred embodiment (illustrated in FIG. 6), at least one of the interruptions between bead sections has at least a portion which is unribbed, e.g., there is no rib in the interruption through which the second line of weakness 27 passes. Typically that line of weakness (like the first) has a wall thickness of about 0.01 inch and is about 0.02 inch in width.

The lines of weakness 16,27 may be formed during molding, by outwardly projecting beads on the core 32, such as bead 44 (situated above grooves 39,42 and below grooves 41,43) for forming the line 16 and a bead 46 for forming line 27.

It will be understood that it is within the scope of the invention to employ the ribs in caps whose overhanging upper lip is not filleted at all or filleted at some angle other than about 30°, caps having no upper lip at all, etc.

As previously described, the cap may have a plug 28 for sealing the mouth of the bottle. Instead of using a plug one may use a gasket. The surface to be sealed, at the mouth of the bottle, may be somewhat rough or uneven, as is the case with many blow-molded light weight milk bottles. In that case I prefer to use a gasket made of a material which will conform to such roughness by taking some local permanent set in response to the pressure between it and the rough surface. One example of such a gasket material is a "non-resilient" foam of, e.g., polystyrene about 0.02 to 0.04 inch (e.g. 0.03 inch) thick. This material can be readily deformed, e.g., it will take, permanently, the imprint of one's fingernail; it is used extensively for cushioning wraps for bottles.

It is found that such "non-resilient" gaskets often do not seal reliably when used in snap-on types of caps on conventional plastic milk bottles. In accordance with one aspect of the invention the reliability of the seal is greatly improved by modifying the shape of the usually flat top wall of the cap so that it acts resiliently on the gasket in an annular zone generally aligned with the underlying annular zone of contact of the gasket and the mouth of the bottle. As shown in FIG. 9 this may be accomplished by using a cap whose top wall 51 has a dished configuration, having a central substantially flat depressed portion 52 and an upwardly rising annular portion 53 (e.g., which may be of generally frusto-conical configuration) with the central depressed portion meeting the upwardly rising marginal portion roughly along a circular line or zone whose diameter is substantially the same as that of the lip 29 at the mouth of the bottle. The dimensions of the cap (including the position of the lower bead 19 and the thickness of the gasket 54) are such that when the cap is snapped onto the filled bottle the top of the gasket is pressed against that zone forcing it upward slightly; e.g., the portion 52 may be forced upward from an original position in which it is, say, about 0.03 inch below the outer marginal area 56 of the cap to a final position in which it is only about 0.015 inch below that area 56.

As mentioned earlier, it is conventional to apply a paper label, having a diameter of about 1⅜ inch (and a thickness of about 0.004 inch) and having a pressure sensitive adhesive underlayer, to the top of the cap and then press the label firmly onto the top by passing the labelled cap under a soft rubber roller having a diameter of say, about 3 inches. I have found that despite the dished configuration of the cap, the labels 57 are easily applied in this way and adhere very well in use, even though the configuration of the top of the labelled cap is changed (as described above) when it is applied to the bottle.

The caps are typically molded of thermoplastic polymer such as a polyolefin. For use on lightweight plastic milk bottles (such as those described in the article in American Dairy Review, April, 1974, pages 36, 38, 40, 60, 62) low density polyethylene is found to be a very suitable cap material, e.g. Tenite polyethylene 18 BO grade A melt index 20.

It is understood that the foregoing detailed description is given merely by way of illustration and that variations may be made therein without departing from the spirit of the invention.

I claim:

1. A molded plastic bottle cap having a substantially circular top wall and an integral side wall having an upper portion and a lower portion, said side wall being formed on its upper portion with an overhang having a larger diameter than the lower portion of said skirt below said overhang, the diameter of said overhang exceeding said lower portion of said skirt below said overhang, said cap having tamper indicating means including means for tightly engaging under a shoulder of a bottle neck to inhibit removal of said cap from said bottle neck unless tamper indication is activated, said tightly engaging means nevertheless permitting said cap to be pulled off said bottle neck without such activation by a strong pull on said cap, wherein the improvement comprises said overhang being filleted at an angle of about 30° to said lower side wall portion.

2. A cap as in claim 1 in which said top wall is substantially flat and has a diameter of at least about 1.5 inches and said upper portion has an outer diameter of about 1.4 inches.

3. A cap as in claim 1 in which said tamper indicating means comprises a skirt removable from said upper side wall portion, and said tightly engaging means comprises a bead projecting internally of said skirt for engaging said shoulder.

4. A cap as in claim 3 in which said cap has a line of weakness to enable said skirt to be torn by hand from said upper side wall portion, and said upper side wall portion has an internally projecting bead for engaging an upper shoulder of said bottle neck.

5. A cap as in claim 4 in which said top wall is substantially flat and has a diameter of about 1.5 inches and said upper portion has an outer diameter of about 1.4 inches.

6. A filled bottle capped with the cap of claim 1, with said tightly engaging means being in operative engagement with a shoulder of the neck of said bottle.

7. A filled bottle capped with the cap of claim 5.

8. A molded plastic bottle cap having a top wall and a side wall, said side wall carrying tamper indicating means including a skirt having a thin wall carrying an inwardly projecting integral bead for tightly engaging under a shoulder of a bottle neck to inhibit removal of said cap from said neck, said bead being interrupted circumferentially by at least one gap, wherein the improvement comprises a rib integrally formed on said thin wall in said gap and projecting inwardly to a lesser extent than said bead.

9. A cap as in claim 8 in which said rib projects internally for a distance insufficient to engage said shoulder.

10. A cap as in claim 9 in which said rib is substantially aligned with said bead and is of substantially lesser width and cross-sectional area than said bead.

11. A filled bottle capped with the cap of claim 8, with said bead being in operative enagement under a shoulder of the neck of said bottle.

12. A plastic cap for sealing a container neck comprising a top disc having a depending skirt, said skirt having first bead means extending around the inside of said skirt spaced downward from said disc, second bead means extending around the inside of said skirt spaced downward from said first bead means, a first scoreline extending circumferentially around said skirt spaced between said first and second bead means, a second scoreline extending up from the bottom edge of said skirt and merging with said first scoreline, tear means on said bottom edge adjacent said second score line, whereby by pulling said tear means upward along said second scoreline and then around said first scoreline, the bottom of said skirt may be torn off by tearing upward along said second scoreline and then around said first scoreline, said first and second bead means being engageable with third and fourth bead means, respectively, on the exterior of said neck to prevent removal of said cap without tearing off the portion of said skirt below said first scoreline, said first bead means comprising first bead sections separated by first gaps, said second bead means comprising second bead sections separated by second gaps, said first gaps being vertically aligned with said second gaps, there being no first bead sections aligned with said second gaps.

* * * * *